US005123686A

United States Patent [19]

Wenk

[11] Patent Number: 5,123,686

[45] Date of Patent: Jun. 23, 1992

[54] TAMPER-PROOF BAG SEAL

[75] Inventor: Joseph H. C. Wenk, Huntington Bay, N.Y.

[73] Assignee: American Casting & Manufacturing Corporation, Plainview, N.Y.

[21] Appl. No.: 768,000

[22] Filed: Sep. 30, 1991

[51] Int. Cl.[5] ..... B65D 63/00

[52] U.S. Cl. ..... 292/321; 24/16 PB; 292/307 R

[58] Field of Search ..... 285/307 R, 310, 318, 285/321, 322; 24/16 PB

[56] References Cited

U.S. PATENT DOCUMENTS

| | | | |
|---|---|---|---|
| 2,809,065 | 10/1957 | Erke . | |
| 2,977,145 | 3/1961 | Rifkin | 292/322 |
| 3,214,808 | 11/1965 | Litwin | 24/16 PB |
| 3,900,922 | 8/1975 | McCormick | 24/16 PB |
| 3,949,449 | 4/1976 | Caveney et al. | 24/16 PB |
| 3,965,538 | 6/1976 | Caveney et al. | 24/16 PB |
| 4,128,220 | 12/1978 | McNeel | 24/16 PB |
| 4,287,644 | 9/1981 | Durand . | |
| 4,306,745 | 12/1981 | Wenk . | |
| 4,441,233 | 4/1984 | Swift | 24/16 PB |
| 4,470,173 | 9/1984 | Adamson . | |
| 4,501,049 | 2/1985 | Adamson | 292/321 |
| 4,506,415 | 3/1985 | Swift . | |
| 4,557,023 | 12/1985 | Six et al. | 24/16 PB |
| 4,580,319 | 4/1986 | Paradis . | |
| 4,688,302 | 8/1987 | Caveney et al. | 24/16 PB |
| 4,898,412 | 2/1990 | Wenk . | |

FOREIGN PATENT DOCUMENTS 2081798A 7/1981 United Kingdom .

*Primary Examiner*—Eric K. Nicholson
*Attorney, Agent, or Firm*—Hoffman & Baron

[57] ABSTRACT

A tamper-proof seal for sealing a bag or the like is provided. The seal includes a housing having a strap engagement device, and a strap coupled to the housing. The strap engagement device includes a locking member that lockingly engages a surface of the strap when the strap is inserted into the housing. The locking device is movable towards the strap upon an attempt to disengage the strap from the locking means. The strap includes a pair of adjacent protuberances located near the housing. When the strap is tightened about a bag, the protuberances clench the bag material while providing a convenient slot in which a knife can be inserted. A loop member may be coupled to the housing. The loop member includes an opening through which the strap is inserted prior to inserting it within the housing.

18 Claims, 10 Drawing Sheets 34
16
9
38
42
8
9
36
40
10
10
56
6
50
50
6
7
12
22
7

TAMPER-PROOF BAG SEAL

BACKGROUND OF THE INVENTION

The present invention relates to bag seals, and more particularly, relates to bag seals for securing bags or the like which may contain valuables such as money.

A bag seal of the above-referenced type is disclosed in U.S. Pat. No. 2,809,065 to Erke which includes a plastic strap that can be drawn about the end of a cloth bag or around a similar object The invention consists of three components a strip, a first sealing member, and a second sealing member. The second sealing member contains a slot with saw-tooth edges that is designed to receive the strip and hold it securely in place. The first sealing member forms a cavity within which the second sealing member fits U.S. Pat. No. 4,506,415 to Swift discloses another security seal designed to discourage tampering. The device includes a strap with teeth The strap is inserted into a housing with coupling ratchet teeth The housing consists of a cover rotated about a hinge into the top of the housing where it latches into engagement by means of a projection.

Another bag seal is disclosed in U.S. Pat. No. 4,287,644 to Durand which includes a strap with teeth where the strap is inserted into a sealing member This sealing member includes a hinged pawl that meshes with a plurality of ratchet teeth on the strap The hinged pawl extends generally parallel to the strap. The horizontal nature of the pawl allows easy insertion but provides resistance when trying to remove the strap.

U.S. Pat. No. 4,306,745 to Wenk discloses a bag seal which includes a strap with teeth attached to a sealing apparatus. The sealing apparatus is tamper resistant and includes a closed box lock arrangement that isolates a ratchet portion of the tie, insuring that the locked bag tie can not be removed without destroying it. The housing box has six walls that enclose a pawl frame, with a bottom wall being formed with a hinge. When the bottom is open, the pawl frame is inserted within the box. Thereafter, the hinged wall is swung shut and ultimately heat sealed to form a secure protective box surrounding the pawl frame The housing has apertures for passing the tie through the housing. The strap includes a number of pointed teeth for penetrating and interlocking with the material of the object held. A pair of spaced logs at the end of the strap portion facilitate the removal of the tie by providing space to cut the tie without injuring a sealed bag.

U.S. Pat. No. 4,470,173 to Adamson discloses a bag seal that resists tampering. The seal includes an enclosure with a passageway in which a strap can be inserted. The strap is held in the enclosure by interacting with a lip. The strap is removed by holding a tab and pulling along a shear line which thereby removes the strap from the article without damaging the article. The seal thereby becomes totally unusable The strap includes spikes which bite into the bag fabric that is being held and serve to prevent the neck of the bag from slipping out of the closed strap.

U.S. Pat. No. 4,506,415 discloses a combination security seal and identification tag holder. A hinged cover mounted to a housing is provided for engaging the saw-toothed surface of a strap.

Another bag seal is disclosed in U.S. Pat. No. 4,580,319 to Paradis. The seal includes a strap with teeth and a locking head containing a pawl. The strap is made of a stress reorientable material The stretching ability of the strap enables the strap to stretch when being tightened around an object. When the wrapping force is released, the strap more effectively achieves the locking action characteristic of the design.

U.S. Pat. No. 4,898,412 discloses a tamper-proof seal including a length of shackling tape which is inserted into a tape-receiving passage having inwardly extending teeth. The seal includes two deformable, type-gripping sections.

U.K. Patent Application GB 2081798A discloses a security seal including a housing having a passage for receiving a flexible strip. The passage includes three sections, the second extending at an angle from the first, and the third extending at an angle from the second.

SUMMARY OF THE INVENTION

It is an object of the present invention to provide a tamper-proof bag seal with enhanced strength and which will show evidence of tampering.

It is another object of the present invention to provide a tamper-proof bag seal having a housing that tightly locks with a strap when attempting to disengage the strap from the housing.

Yet another object of the present invention is to provide a tamper-proof bag seal having a gripping member for clenching the bag when the strap is encircled around a bag, and further providing a slot for inserting a knife or the like to cut the strap.

A still further object of the present invention is to provide a tamper-proof bag seal which is resistant to the use of a shim.

In accordance with these and other objects of the invention, the present invention provides a tamper-proof bag seal including a housing having a passage extending therethrough, strap engagement means, and a strap coupled to the housing. The strap engagement means includes locking means for lockingly engaging a surface of the strap when the strap is at least partially positioned within the passage. The tamper-proof bag seal further includes means for moving the locking means toward the strap. The moving means is actuable upon an attempt to disengage the strap from the locking means.

In accordance with another embodiment of the present invention, a tamper-proof bag seal is provided that includes a housing having a passage extending therethrough, and a strap coupled to the housing having a free end insertable into the passage and forming a loop when inserted into the passage The housing further includes locking means for lockingly engaging a surface of the strap when the strap is at least partially positioned within the passage. The strap further includes first and second protuberances defining a slot therebetween, the protuberances being in spaced relation such that when the strap is formed into a loop and tightened about the neck of a bag, the protuberances clench the bag while the slot remains at least partially open to allow a cutting instrument to be inserted therein.

In accordance with another embodiment of the present invention, a tamper-proof bag seal is provided that includes a housing having a passage extending therethrough and an entrance opening communicating with the passage, and a strap coupled to the housing and having a free end insertable into the passage. The housing further includes a loop secured thereto. The strap is insertable through the loop prior to its insertion within the entrance opening of the housing. A connecting member is provided for connecting the loop to the housing. The connecting member is severable from the loop in order to provide evidence of possible tampering.

DETAILED DESCRIPTION OF THE INVENTION

A tamper-proof bag seal 10 is provided for sealing the open end of a bag 11 or the like. The bag may, for example, contain money, jewelry or other valuables.

When valuables are stored or transported, such as with money bags, they must be secured against undetected tampering. Thus, if a bag seal is used, it must be tamper-proof in that it must provide obvious evidence that it has been opened or otherwise tampered with. The bag seal 10 provided herein is secured around the neck of a bag, and is tamper-proof in that it will not disengage from the bag without obvious signs of interference, such as being cut or destroyed in some manner.

Figure 1:
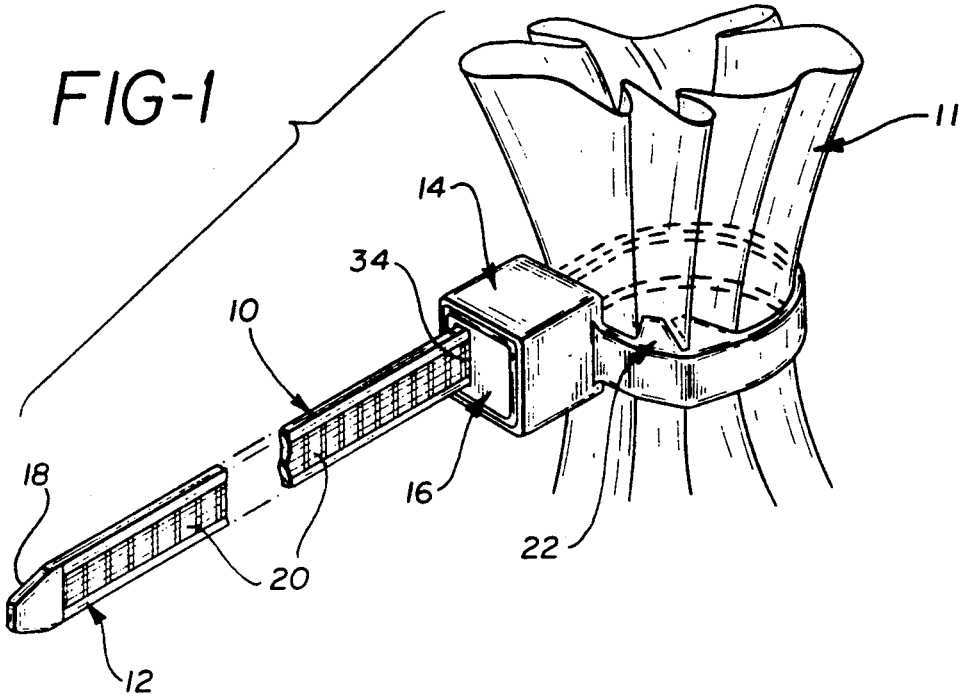
FIG. 1 is a perspective view of a tamper-proof bag seal according to a first embodiment of the invention shown encircling the neck of a bag.
Figure 2:
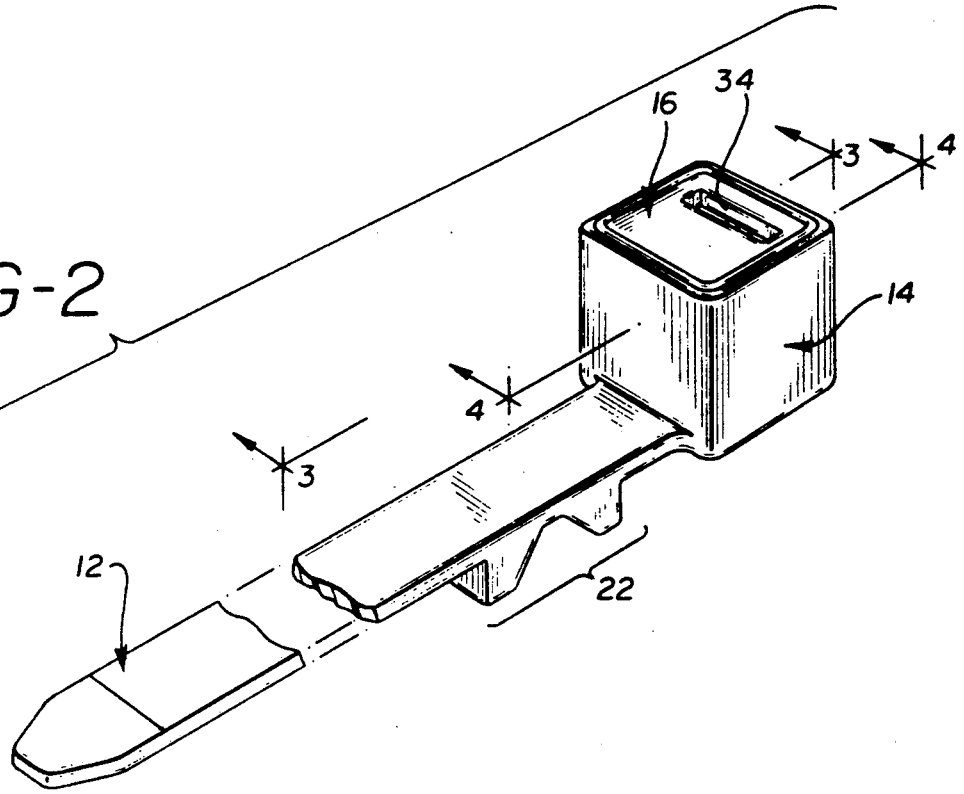
FIG. 2 is a top perspective view of the tamper-proof bag seal.
Figure 3:
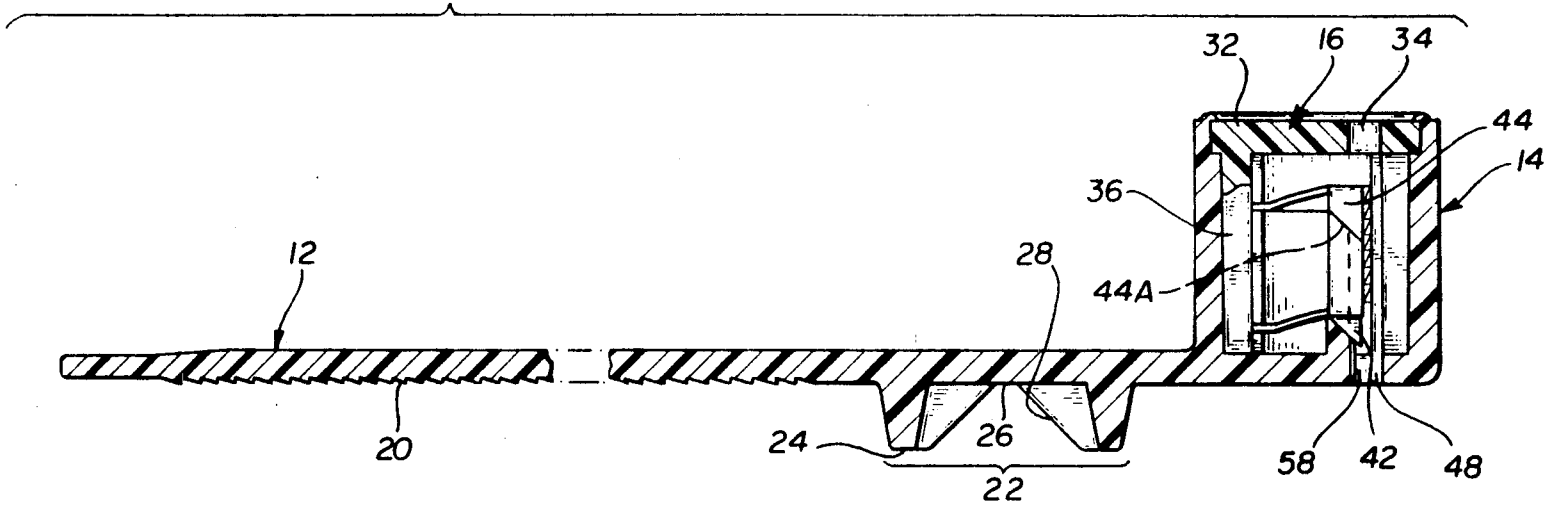
FIG. 3 is a longitudinal cross-sectional view of the tamper-proof bag seal taken along line 3—3 of FIG. 2.
Figure 4:
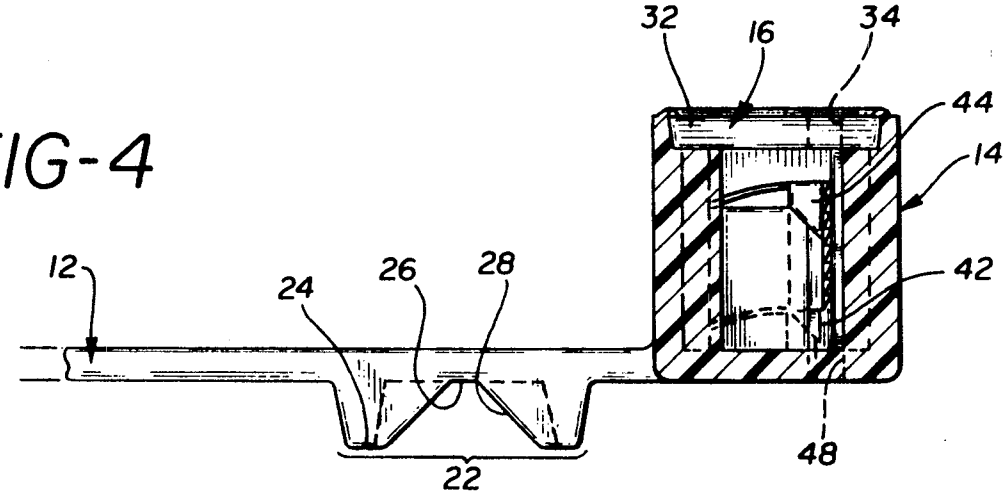
FIG. 4 is a partially cross-sectional, side elevation view of the housing of the tamper-proof bag seal taken along line 4—4 of FIG. 2.

Referring to FIGS. 1 and 2, the bag seal 10 basically includes a strap 12, a housing 14, and a strap engagement member 16 positioned within the housing. The housing 14 is preferably coupled to one end of the strap. The strap and housing may be integrally formed from a semi-rigid polymeric material such as polypropylene which has a Rockwell hardness of at least about R100. The opposite end 18 of the strap is preferably tapered.

Figure 7:
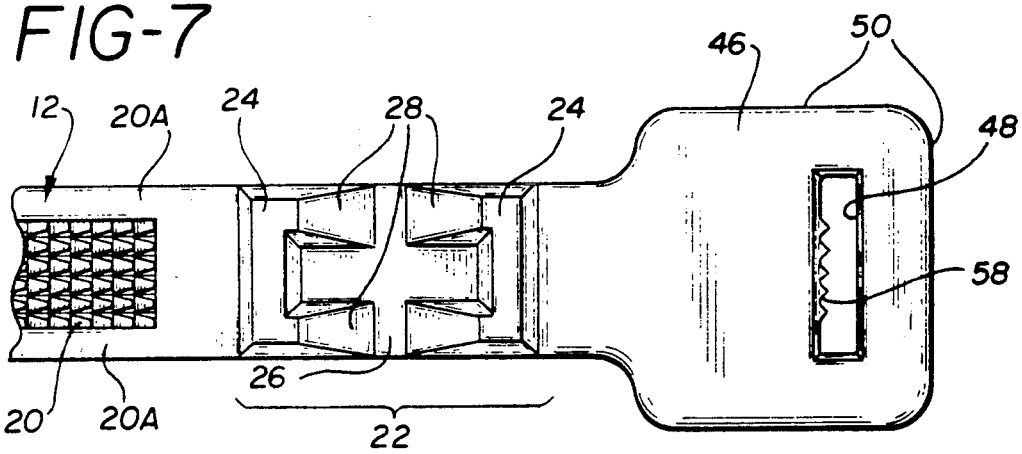
FIG. 7 is a bottom plan view thereof.

The strap 12 includes ratchet teeth 20 in one of its sides. As shown in FIG. 7, the ratchet teeth 20 are divided into rows and columns, the columns extending parallel to a pair of opposing ridges 20A which extend longitudinally along substantially the entire length of the strap. The ratchet teeth extend no higher than the plane defined by the top surfaces of the ridges. The ridges adjoin the edges of the strap. The opposite side of the strap has a substantially smooth surface.

The strap 12 further includes an integrally formed gripping member 22 extending from the same side of the strap as the ratchet teeth 20, and preferably proximate to the housing 14. The gripping member 22 includes opposing protuberances 24 defining a slot 26 therebetween. The opposing protuberances each include a pair of opposing sloped surfaces 28 adjoining the slot whereby the protuberances are foldable towards each other about an axis extending through the slot.

Figure 8:
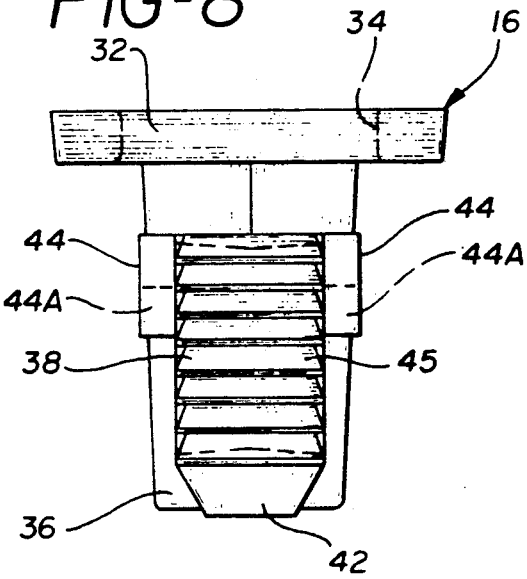
FIG. 8 is an enlarged front elevation view of the strap engagement means.
Figure 9:
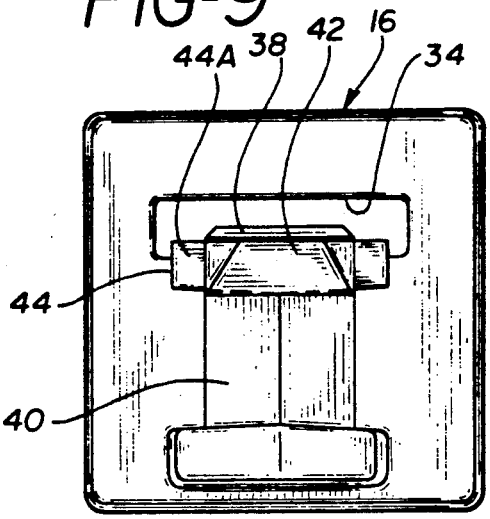
FIG. 9 is a bottom plan view thereof.
Figure 10:
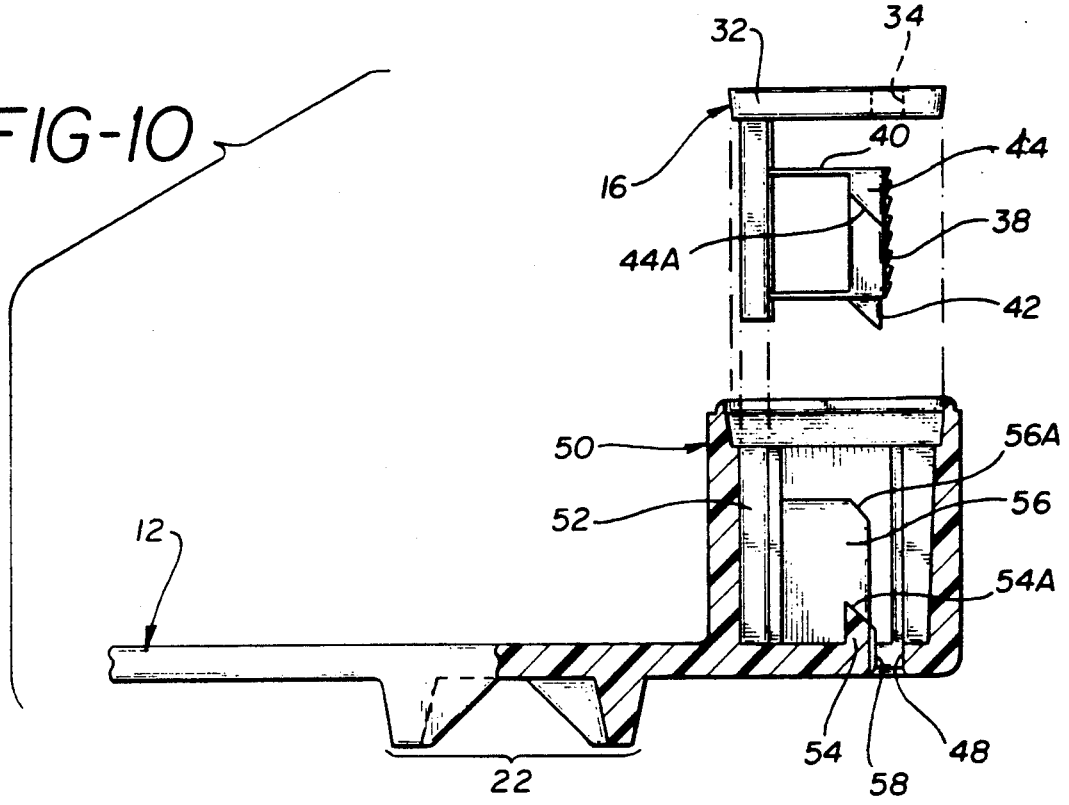
FIG. 10 is an exploded, partially cross-sectional side elevational view of the tamper-proof bag seal.

Referring to FIGS. 8, 9 and 10, the strap engagement member 16 is preferably integrally molded and includes a first wall 32 having a rectangular opening 34, and a second wall 36 The first wall 32 and second wall 36 are connected to each other to form a substantially "L-shaped" configuration. A locking member 38 is attached to the second wall 36 of the strap engagement member 16 by two resilient legs 40. The locking member 38 includes a wedge-shaped end 42 extending beyond the resilient leg 40 farthest from the first wall 32. A pair of laterally extending wedges 44 are formed on opposing sides of the locking member 38 proximate to the first wall. The end 42 and wedges 44 each include inclined surfaces 42A, 44A which are in generally opposing relation to the second wall 36. The inclined surfaces 44A of the wedges 44 are substantially coplanar, and are generally parallel to the inclined end surface 42A of the locking member 38.

The locking member 38 includes a plurality of laterally extending ratchet teeth 45. As shown in FIG. 9, the ratchet teeth extend higher than the lower surface of the rectangular opening 34 within the first wall 32.

Figure 5:
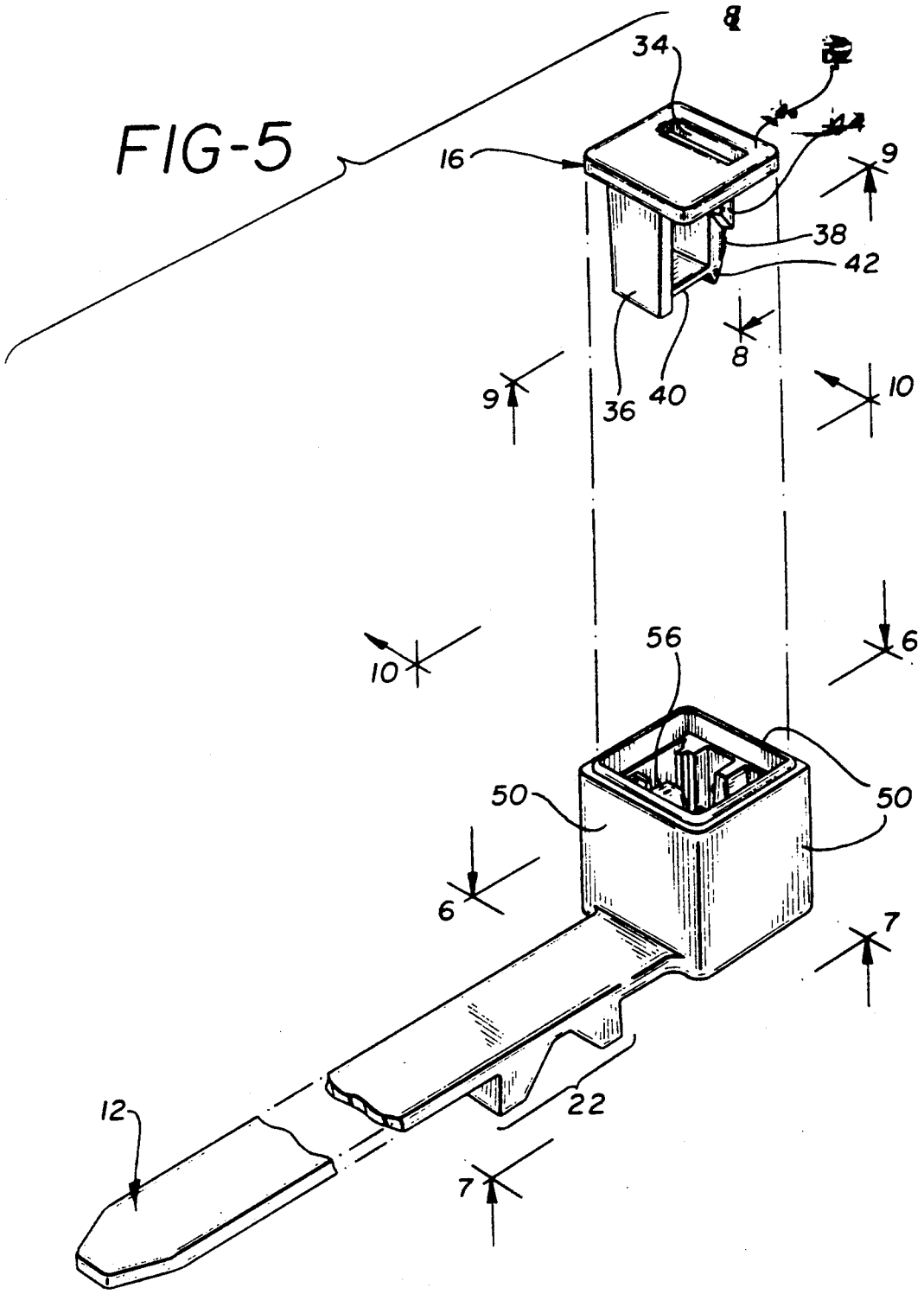
FIG. 5 is an exploded, perspective view of the tamper-proof bag seal shown in FIG. 2.
Figure 6:
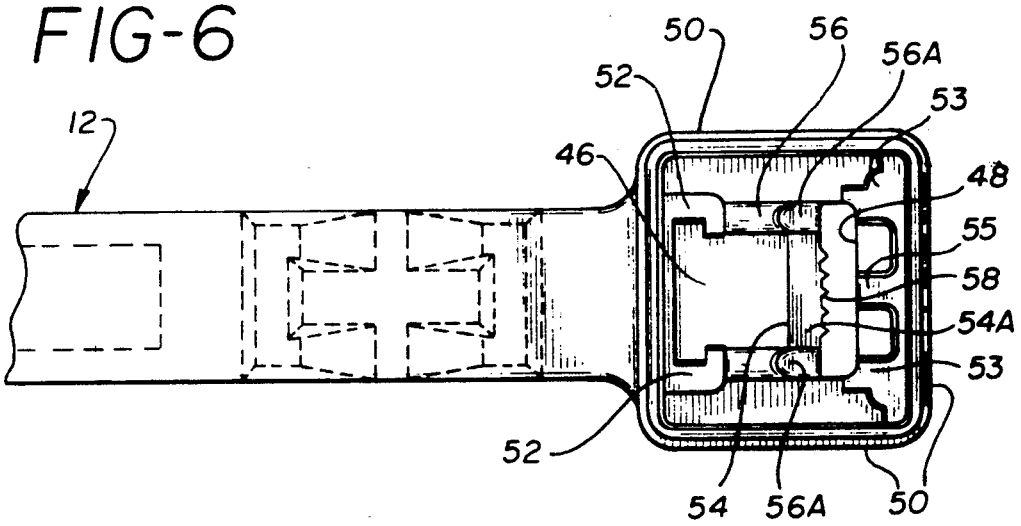
FIG. 6 is a top plan view of a portion of the tamper-proof bag seal showing the housing thereof.

As shown in FIG. 5, the housing 14 preferably includes four adjoining walls 50 forming a substantially square configuration. As shown in FIGS. 6 and 7, it further includes an end wall 46 having a rectangular aperture 48 for receiving the tapered end of the strap 18. The housing is preferably coupled to the strap such that the end wall 46 is level with a surface of the strap 12. A pair of L-shaped members 52, as shown in FIG. 6, define a channel for receiving the second wall 36 of the strap engagement member 16.

Figure 13:
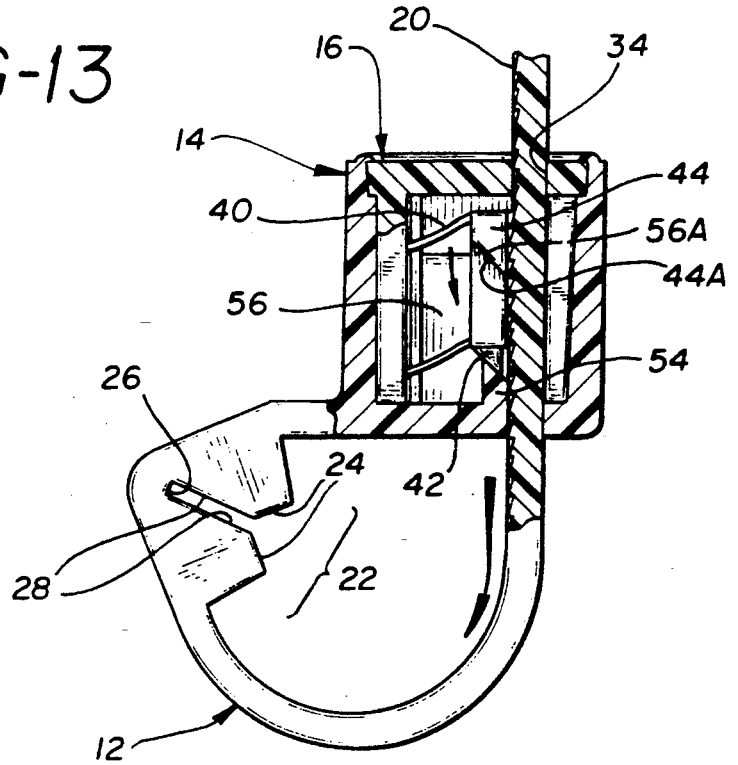
FIG. 13 is a similar view showing the relation of the strap engagement means and housing when the strap is pulled in the direction opposite to the direction of insertion.

The housing 14 further includes a pair of walls 56 which are integral with the L-shaped members 52 and extend to the rectangular aperture 48 Each of the walls 56 includes an inclined surface or ramp 56A opposing the open end of the housing 14. A wall 54 extends laterally between the projections and includes an inclined surface 54A which also opposes the open end of the housing. The inclined surface 54A of the wall 54 runs parallel to the inclined surfaces 56A of the walls 56, and functions as an additional ramp. When the strap engagement member 16 is fully inserted within the housing 14, the inclined surface 54A of the wall 54 is engaged by the inclined surface 42A of the locking member 38, and the ramps 56A defined by the walls 56 are engaged by the wedges 44. The respective inclined surfaces interact such that the locking member 38 is urged away from the second wall 36 of the strap engagement member 16 when a force in the direction of the end wall 46 is applied thereto. Such a force is typically applied when one attempts to remove the strap from the housing 14, as shown in FIG. 13. The force applied by the locking member 38 to the strap significantly increases as the strap is pulled in this direction.

The aperture 48 in the end wall 46 of the housing 14 includes a plurality of longitudinal ridges 58 as shown in FIGS. 6 and 7. The ridges are spaced such that they fit between the columns of ratchet teeth 20 within the strap 12. This arrangement provides protection against shimming.

The seal 10 is assembled by inserting the strap engagement member 16 within the housing until the first wall 32 thereof engages the ends of the L-shaped members 52 and the ends of three additional projections 53, 55 extending from an opposite wall of the housing 14. Each of the three additional projections 53, 55 extends longitudinally within the housing and includes a longitudinal surface adjoining the aperture 48. The strap engagement member is then permanently secured to the housing by ultrasonic welding or other appropriate techniques. The aperture 48 within the end wall 46 of the housing and the opening 34 extending through the first wall 32 of the strap engagement member 16 are aligned when the seal is assembled.

Figure 11:
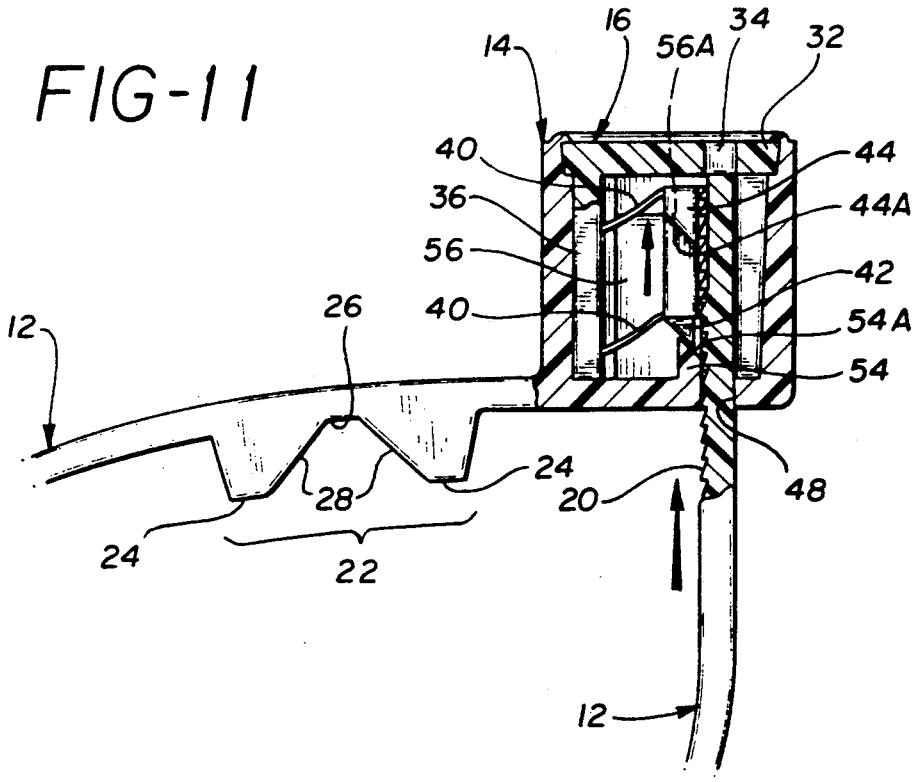
FIG. 11 is a partially sectional, side elevation view of the tamper-proof bag seal wherein the strap is partially inserted within the housing.

In operation, referring to FIG. 11, the strap 12 is inserted through the aperture 48 in the housing, thereby forming a loop with the ratchet teeth 20 of the strap facing inwardly with respect to the loop. The strap ratchet teeth 20 engage with the ratchet teeth 45 of the locking member 38. The resilience of the legs 40 supporting the locking member 38 facilitates strap insertion as the locking member pivots about the legs and towards the first wall 32 of the strap engagement member 16. Additional space is accordingly created between the locking member 38 and the opposing surface of the housing 14.

Figure 12:
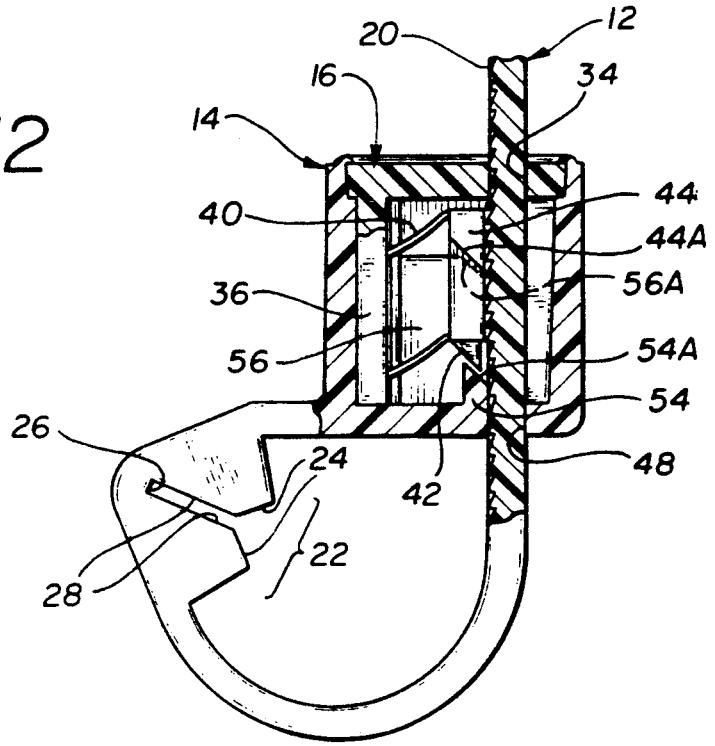
FIG. 12 is a similar view showing the strap extending through the housing.

As the strap is pulled tight about a bag or the like, as shown in FIG. 12, the opposing protuberances 28 of the gripping member 22 fold about the slot 26. The protuberances clench the bag and provide further securing of the tamper-proof bag seal 10 to the bag. The slot 26 never completely closes upon tightening the strap. A knife or other such instrument may accordingly be inserted within the slot should one wish to cut the strap.

The plurality of ridges 58 which project into the aperture 48 in the rear wall 46 of the housing 14 fit between the ratchet teeth columns, thereby preventing lateral motion when the strap is inserted into the housing. The strap cannot be tilted, angled, or moved from side to side in an attempt to disengage the strap from the housing. When the strap is fully inserted within the housing, the legs 40 resiliently urge the locking member 38 towards the strap and the sets of ratchet teeth into engagement.

When the strap is pulled in the opposite direction from insertion, as shown in FIG. 13, the engaged strap and locking member ratchet teeth 20, 45 prevent movement of the strap. The resilient legs 40 attached to the locking member 38 allows it to move in the direction of the strap. However, any movement of the strap towards the insertion aperture 48 causes the legs 40 to straighten, thereby moving the teeth into even stronger engagement. As discussed above, the inclined surfaces 42A, 44A of the locking member 38 are engaged by the inclined surfaces 54A, 56A of the housing 14 when the strap is pulled in this direction. The locking member 38 is forcefully urged towards the strap under such conditions. A very large force is accordingly required to disconnect the strap and locking member Such a force would likely destroy the seal 10 and provide clear evidence of tampering.

The tamper-proof bag seal in accordance with the present invention preferably has a polypropylene housing and an acetyl strap engagement member. The locking arrangement provided by the strap, the housing, and the strap engagement means is unlikely to disengage before the strap itself breaks.

A second, and preferred, embodiment of the invention is shown in FIGS. 14–21.

Figure 14:
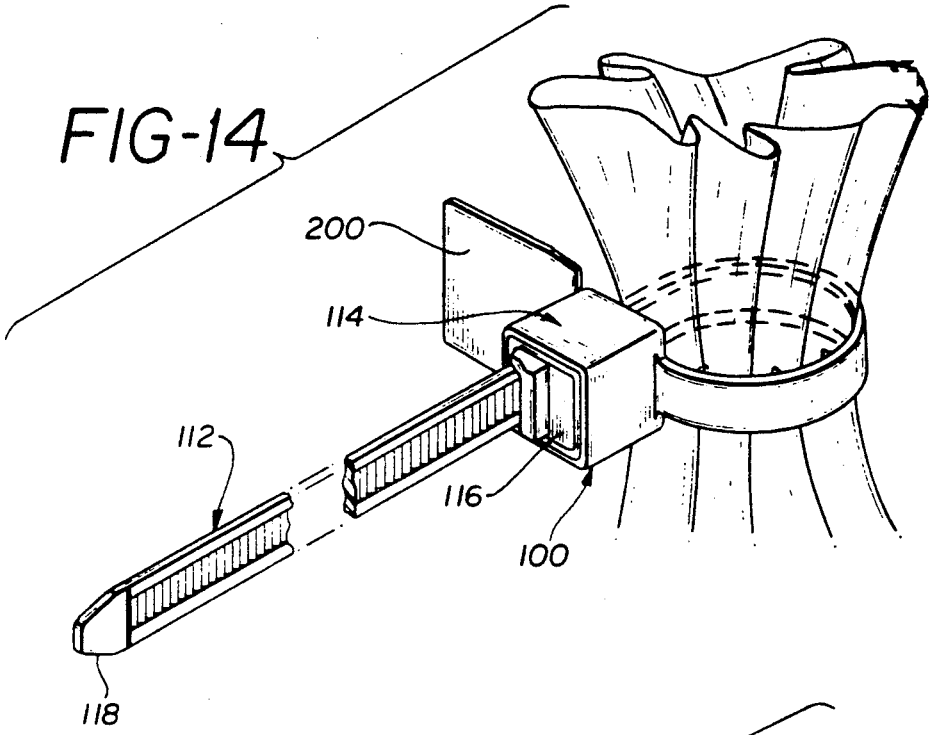
FIG. 14 is a perspective view of a tamper-proof bag seal according to a second embodiment of the invention as secured to the neck of a bag.
Figure 15:
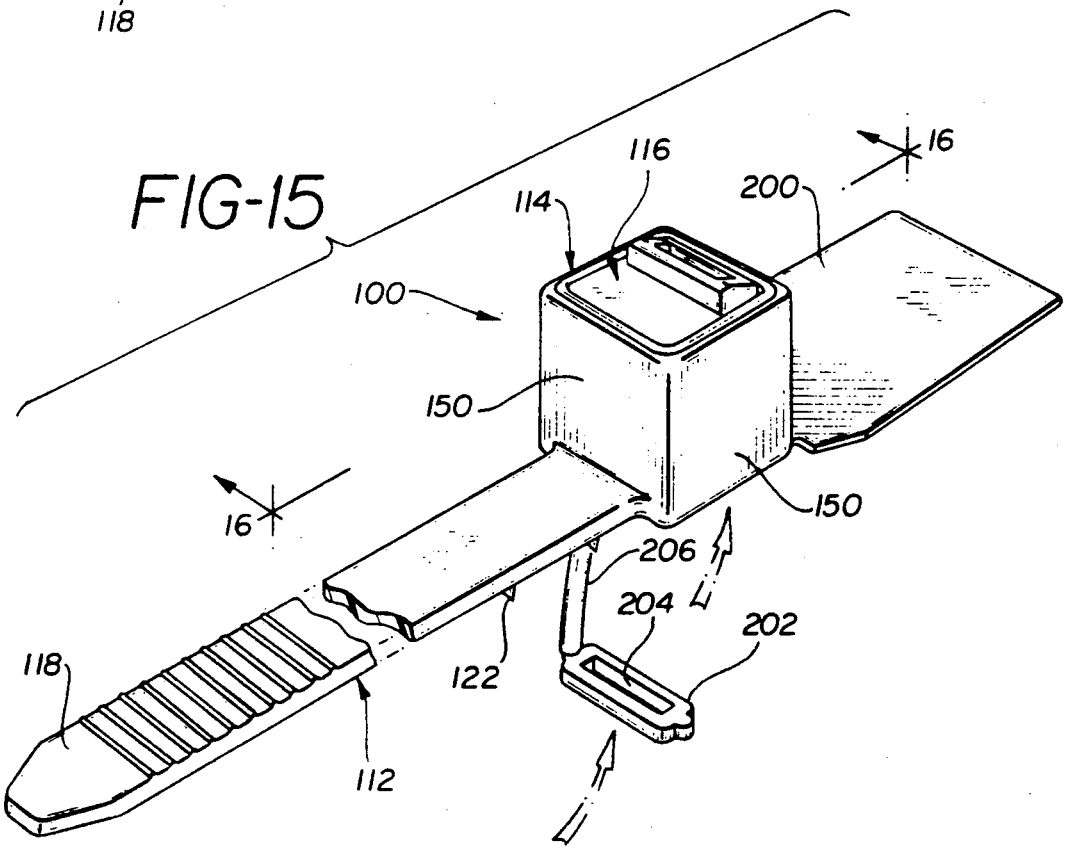
FIG. 15 is a top perspective view of the seal shown in FIG. 14.

Referring to FIGS. 14 and 15, the bag seal 100 basically includes a strap 112, a housing 114, and a strap engagement member 116 positioned within the housing. The housing 114 is coupled to one end of the strap. The strap and housing may be integrally formed from a semi-rigid polymeric material such as polypropylene which has a Rockwell hardness of at least about R100. The opposite end 118 of the strap is preferably tapered.

The strap 12 includes ratchet teeth 120 extending from one of its sides. As shown in FIG. 15, the ratchet teeth 120 extend laterally across the strap. A plurality of conical spikes 122 also extend from this side of the strap. The spikes are positioned between the housing 114 and the portion of the strap including the ratchet teeth. The spikes dig into the neck of a bag when the strap is tightened about it, thereby preventing the seal from being slipped off and re-applied. The opposite side of the strap has a substantially smooth surface.

Referring to FIGS. 16, 17, 18, 20 and 21, the strap engagement member 116 is preferably integrally molded and includes a first wall 132 having a rectangular passage 134 extending therethrough, and a second wall 136. The first wall 132 and second wall 136 are connected to each other to form a substantially "L-shaped" configuration. A locking member 138 is attached to the second wall 136 of the strap engagement member 116 by two resilient legs 140. The locking member 138 includes a wedge-shaped end 142 extending beyond the resilient leg 140 farthest from the first wall 132. A pair of laterally extending wedges 144 are formed on opposing sides of the locking member 138 proximate to the first wall. A plurality of laterally extending ratchet teeth 145 extend from the locking member 138 such that when the strap engagement member 116 is positioned within the housing 114, the teeth 145 engage the teeth 120 of the strap 112.

Figure 16:
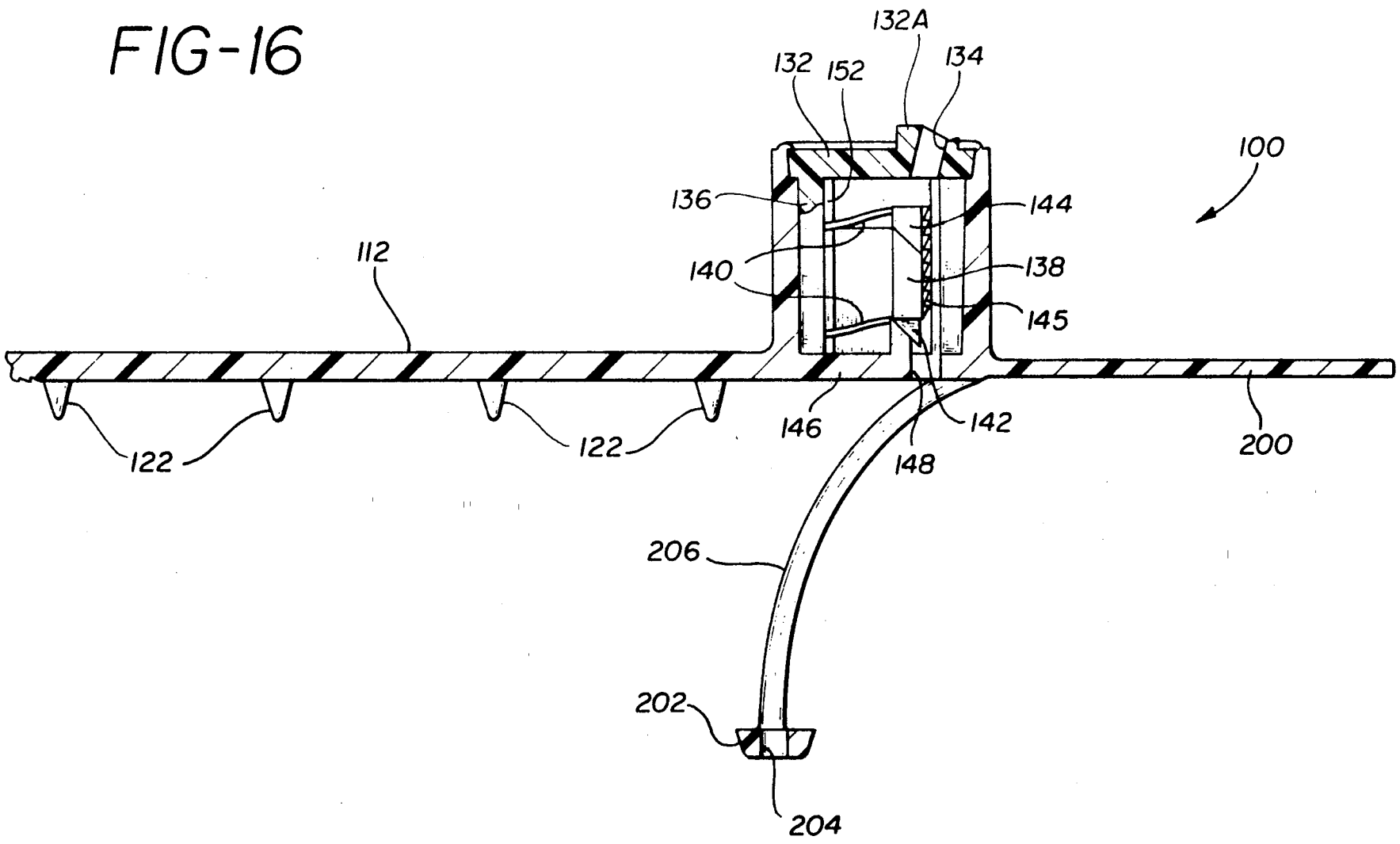
FIG. 16 is a sectional view thereof taken along line 16—16 of FIG. 15.
Figure 17:
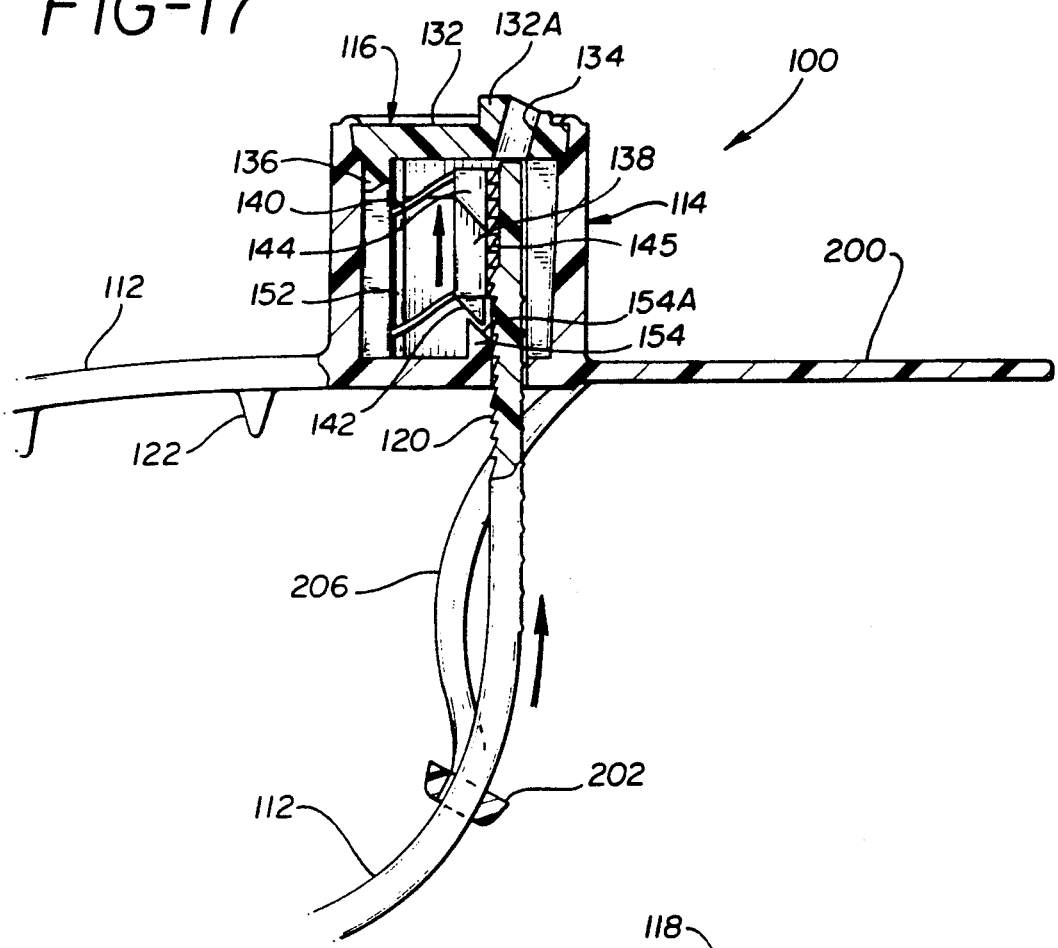
FIG. 17 is a sectional view thereof showing the strap portion of the seal partially inserted within the housing thereof.
Figure 18:
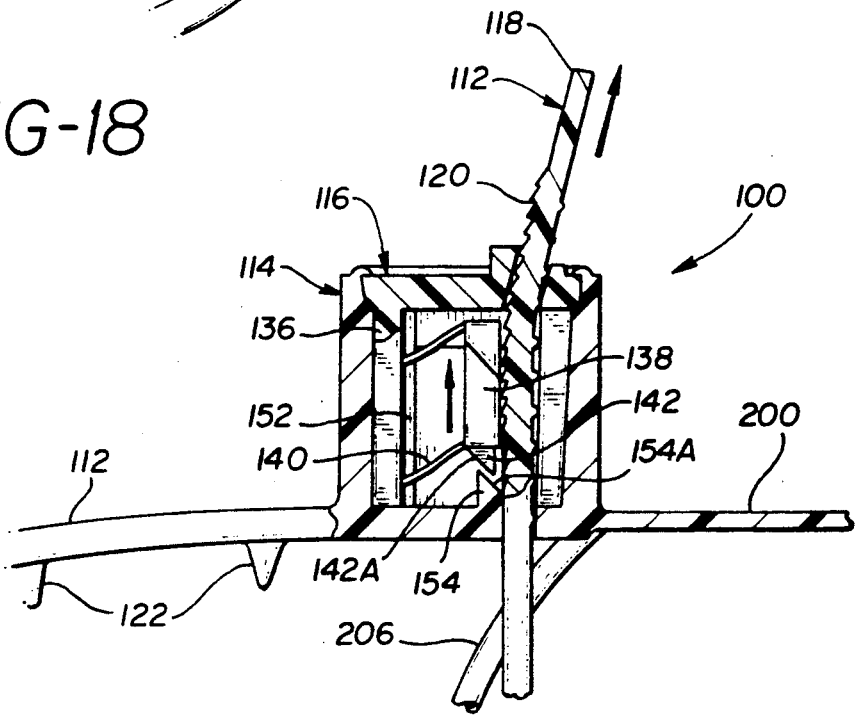
FIG. 18 is a sectional view showing the strap portion of the seal extending through the housing thereof.
Figure 19:
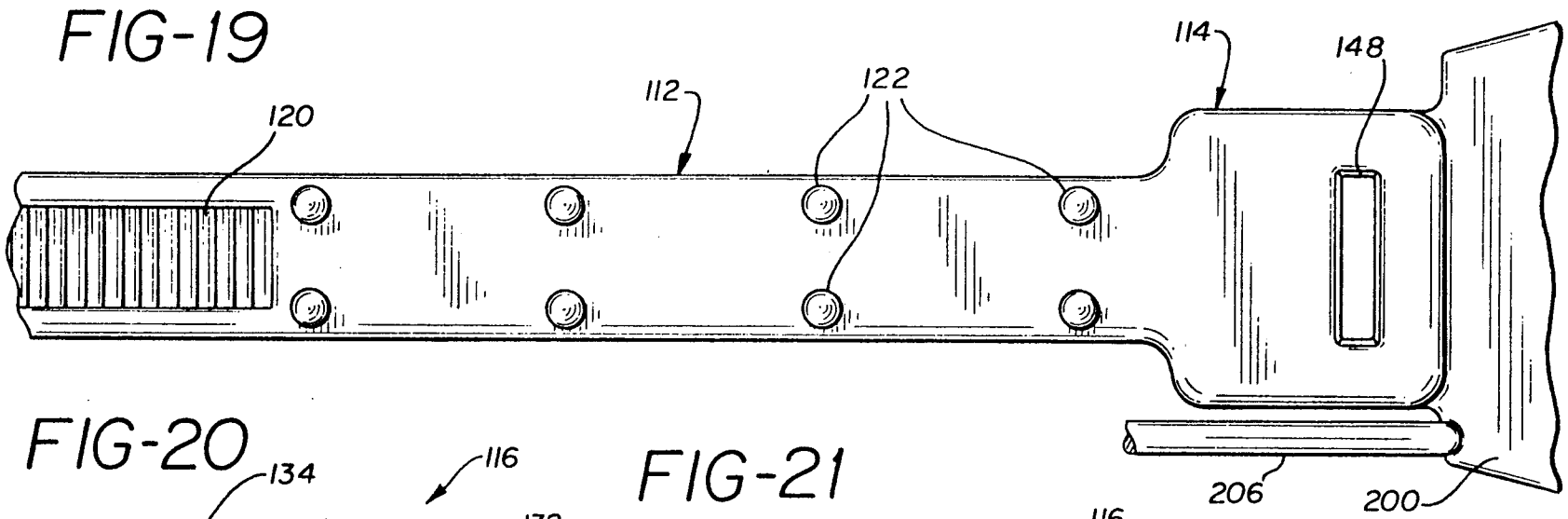
FIG. 19 is a bottom plan view of the seal.
Figure 21:
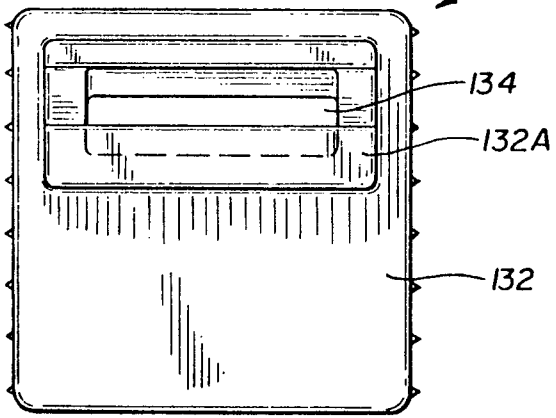
FIG. 21 is a top plan view thereof.
Figure 20:
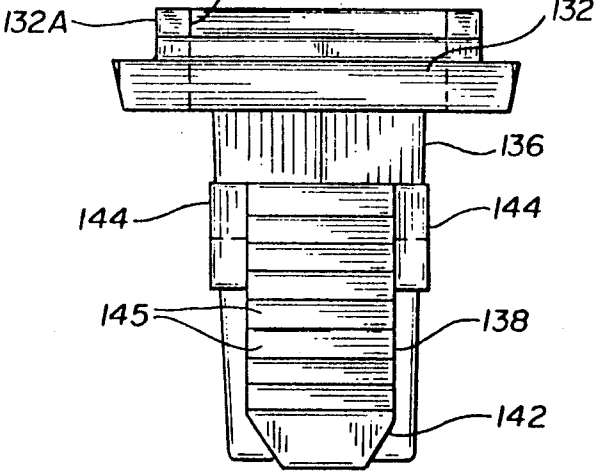
FIG. 20 is an enlarged front elevation view of a strap engagement member positionable within the housing.

The strap engagement member 116 is substantially the same in construction as that described with respect to FIGS. 1–13 with the exception of the first wall 132 and passage 134. The first wall includes a protrusion 132A extending therefrom, the passage 134 extending through the protrusion. In addition, the passage 134 extends at an angle with respect to the locking member 138, rather than parallel thereto. This arrangement makes the use of a shim more difficult for one attempting to tamper with the seal The housing 114 is substantially identical to that described with respect to FIGS. 1–13, and accordingly is not described in as great detail as housing 14. Like housing 14, it includes four adjoining walls 150 forming a substantially square configuration. As shown in FIGS. 16–18, it further includes an end wall 146 having a rectangular aperture 148 for receiving the tapered end of the strap 118. A pair of L-shaped members 152, similar to those shown in FIG. 6, define a channel for receiving the second wall 136 of the strap engagement member 116

The housing 114 includes a pair of projections (not shown) similar to those which extend between the L-shaped members 52 and the rectangular aperture 48 of the housing 14 discussed above. Each of the projections includes an inclined surface or ramp opposing the open end of the housing 114. A wall 154 extends laterally between the projections and includes an inclined surface 154A, as shown in FIGS. 17–18, which also opposes the open end of the housing. The inclined surface 154A of the wall 154 also functions as a ramp. When the strap engagement member 116 is fully inserted within the housing 114, the inclined surface 154A of the wall 154 is engaged by the inclined surface 142A of the locking member 138 in the same manner that the corresponding elements of the seal 10 cooperate. Likewise, the locking member 138 is urged away from the second wall 136 of the strap engagement member 116 when a force in the direction of the end wall 146 is applied thereto. Such a force is typically applied when one attempts to remove the strap from the housing 114. The force applied by the locking member 138 to the strap significantly increases as the strap is pulled in this direction.

There are only two differences between the housing 114 and the housing 14 shown in FIG. 1. Referring to Figs. 15 and 16, the housing 114 includes an integral tab 200 extending from the end wall 146 thereof in the direction opposite from the strap 112. The tab is generally flat and rectangular, and has a width exceeding that of the end wall 146. A loop 202 having a rectangular opening 204 is secured to the tab 200 by a flexible, elongate connecting member 206. The connecting member has sufficient length and flexibility to allow the loop to be aligned with the aperture 148 in the end wall 146 of the housing 114. It is also sufficiently weak that it will break fairly easily if tampered with once the seal 100 has been applied to the neck of a bag.

The seal 100 is assembled by inserting the strap engagement member 116 within the housing 114 in the same manner described with respect to seal 10. The strap engagement member 116 is permanently secured to the housing by ultrasonic welding or other appropriate techniques The aperture 148 within the end wall 146 of the housing and the end of the passage 134 extending through the first wall 132 of the strap engagement member 116 are aligned when the seal is assembled.

In operation, referring to FIGS. 14, 17 and 18, the strap 112 is inserted through the loop 202 and then the aperture 148 in the housing The ratchet teeth 120 and the spikes 122 of the strap accordingly face inwardly. The strap ratchet teeth 120 engage with the ratchet teeth 145 of the locking member 138 as shown in FIG. 18. The resilience of the legs 140 supporting the locking member 138 facilitates strap insertion as the locking member pivots about the legs and towards the first wall 132 of the strap engagement member 116. Additional space is accordingly created between the locking member 138 and the opposing surface of the housing 14.

As the strap is pulled tight about a bag or the like, as shown in FIG. 14, the spikes 122 dig into the bag material. The loop 202 moves into close proximity to the aperture 148, and is substantially hidden by the bag material. The connecting member 206 protrudes from the housing 114, and provides a convenient loop to which a label or other identifying tag can be secured. When the strap is fully inserted within the housing, the legs 140 resiliently urge the locking member 138 towards the strap and the sets of ratchet teeth into engagement.

When the strap is pulled in the opposite direction from insertion, the engaged strap and locking member ratchet teeth 120, 145 prevent movement of the strap. The resilient legs 140 attached to the locking member 138 allows it to move in the direction of the strap. However, any movement of the strap towards the insertion aperture 148 causes the legs 140 to straighten, thereby moving the teeth into even stronger engagement. As discussed above, the inclined surfaces of the locking member 138 are engaged by the inclined surfaces of the housing 114 when the strap is pulled in this direction. The locking member 138 is forcefully urged towards the strap under such conditions. A very large force is accordingly required to disconnect the strap and locking member. Such a force would likely destroy the seal 100 and provide clear evidence of tampering.

The use of a shim to open the seal 100 is likely to be unsuccessful, and will almost certainly result in obvious evidence of tampering. The thickness of the wall 132 adjacent the passage 134, and the angular orientation of the passage make the insertion of a shim difficult and its use even more difficult. In addition, the lateral cross section of the strap has almost the same dimensions as the passage. Inserting a shim through the rectangular aperture 148 in the housing will also likely be unsuccessful or lead to evidence of tampering. The loop 202 and integral connecting member 206 are frangibly connected, and will separate if the shim is used with sufficient force to gain entrance to the housing 114. In addition, the loop is substantially obscured by the bag material which holds it in place. One attempting to use a shim to open the seal would be unlikely to even notice it until too late.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A tamper-proof seal for closing bag or the like, comprising:

a housing, said housing including a passage extending therethrough and an entrance opening communicating with said passage;

a strap coupled to said housing, said strap including a free end insertable into said passage;

said housing further including strap engagement means coupled to said housing, said strap engagement means including locking means including a strap engagement surface for lockingly engaging a surface of said strap when said strap is at least partially positioned within said passage;

means for moving said locking means towards said strap when said strap is at least partially within said passage, said moving means being actuable upon an attempt to disengage the strap from the locking means, said moving means including means for maintaining said strap engagement surface of said locking means substantially parallel to said surface of said strap at substantially all times and for resiliently urging said strap engagement surface towards said strap;

means for moving said locking means in a direction parallel to the direction of insertion of said strap into said passage, said housing including means for abutting against said locking means upon movement of said locking means towards said entrance opening, thereby preventing said locking means from being moved further towards said entrance opening.

2. The tamper-proof seal as described in claim 1 wherein said strap engagement means include a plurality of ratchet teeth and said strap includes a plurality of ratchet teeth which are engageable with said ratchet teeth of said strap engagement means.

3. The tamper-proof seal as described in claim 1 wherein said strap engagement means include a support and first and second legs connecting said locking means to said support, said legs being flexible such that said locking means are moveable with respect to said support and towards said strap when said strap is at least partially within said passage, said means for abutting against said locking means preventing said legs from flexing towards said entrance opening beyond a selected point.

4. The tamper-proof bag seal as described in claim 1 wherein said locking means include an inclined surface generally opposing said entrance opening, said housing including an inclined surface opposing said inclined surface of said locking means and engageable therewith upon movement of said locking means towards said entrance opening.

5. The tamper-proof seal as described in claim 1 wherein said locking means include first and second laterally extending projections, each of said projections including an inclined surface generally opposing said entrance opening, said housing including a pair of inclined surfaces opposing said inclined surfaces of said projections and engageable therewith upon movement of said locking means towards said entrance opening.

6. The tamper-proof bag seal as described in claim 1 including a pair of opposing protuberances extending from said strap, said protuberances defining a narrow slot therebetween, said protuberances defining a pair of opposing surfaces arranged such that when said strap is inserted into said passage, thereby forming a loop, and then tightened about the neck of a bag, said opposing surfaces defined by said protuberances clench the bag while said slot remains at least partially open.

7. The tamper-proof seal as described in claim 1 wherein said housing includes a wall extending substantially perpendicularly with respect to said passage, said wall including said entrance opening communicating with said passage and an abutment surface, said abutment surface engaging said locking means upon an attempt to remove said strap from said housing through said entrance opening.

8. The tamper-proof seal as described in claim 1 including a loop second to said housing by a flexible connecting member, said loop including an opening through which the strap may be inserted.

9. The tamper-proof seal as described in claim 8 wherein said loop is frangibly secured to said connecting member.

10. The tamper-proof seal as described in claim 1 including means for substantially completely enclosing said locking means within said housing such that said locking means is substantially inaccessible from outside said housing.

11. The tamper-proof seal as described in claim 10, wherein said locking means include a locking member having a wedge-shaped end, said housing including an end wall through which said entrance opening extends and an abutment wall extending substantially perpendicularly from said end wall, said abutment wall being engageable with the wedge-shaped end of said locking member and preventing movement of said locking member and said means for moving said locking means in a direction parallel to the direction of insertion of said strap.

12. The tamper-proof seal as described in claim 11 wherein said abutment wall has an inclined surface for engaging the wedge-shaped end of said locking member.

13. The tamper-proof seal of claim 1 wherein said housing includes a plurality of walls substantially enclosing said locking means, said entrance opening extending through one of the walls of said housing, said strap engagement means including a first wall having a strap exit opening communication with said passage and a second wall extending substantially perpendicularly with respect to said first wall, said second wall being supported by one of the walls of said housing, said locking means including a locking member, said means for moving said locking means towards said flap including flexible support means connected between said locking member and said second wall of said strap engagement means.

14. A tamper-proof bag seal for closing a bag or the like, comprising:

a housing, said housing including a passage extending therethrough and an end wall including an aperture communicating with said passage;

a tab extending from said housing and parallel to said end wall, said tab having a larger width than said end wall;

a strap coupled to said coupled to said housing, said strap including a free end insertable into said passage and forming a loop when inserted into said passage;

means for engaging said strap within said housing;

a loop member; and a flexible, thin connecting member connecting the loop member to the tab extending from said housing, the loop member including an opening through which the strap can be inserted, the connecting member having sufficient length that the loop member is positionable in adjoining relation to the aperture in said end wall, said connecting member being connected to said tab in a laterally offset position with respect to said end wall.

15. A seal as described in claim 14 wherein the loop member is frangibly connected to the connecting member.

16. A seal as described in claim 14 wherein said means for engaging said strap includes a locking member including a plurality of ratchet teeth, said strap including a plurality of ratchet teeth which are engageable with the ratchet teeth of the locking member when the strap extends through the passage, and means for resiliently supporting said locking member.

17. A tamper-proof bag seal for closing a bag or the like, comprising:

a housing, said housing including a passage extending therethrough and an entrance opening adjoining said passage;

a strap coupled to said housing, said strap including a free end insertable into said passage;

strap engagement means coupled to said housing, said strap engagement means including locking means for lockingly engaging a surface of said strap when said strap is at least partially positioned within said passage, said locking means including first and second laterally extending projections, each of said projections including an inclined surface generally opposing said entrance opening;

said housing including a pair of inclined surfaces opposing said inclined surfaces of said projections and engageable therewith upon movement of said locking means towards said entrance opening;

means of resiliently supporting said locking means such that said locking means are movable in a direction parallel to the direction of insertion of said strap into said passage through said entrance opening; and means for moving said locking means towards said strap, said moving means being actuable upon an attempt to disengage said strap from said locking means.

18. A tamper-proof bag seal as described in claim 17 wherein said locking means include a locking member supported by a pair of flexible legs, said housing includes an end wall through which said entrance opening extends, said locking member being engageable with said end wall upon movement of said locking member towards said entrance opening.

* * * * *